US006653986B2

(12) United States Patent
Watada et al.

(10) Patent No.: US 6,653,986 B2
(45) Date of Patent: Nov. 25, 2003

(54) MEANDER ANTENNA AND METHOD FOR TUNING RESONANCE FREQUENCY OF THE SAME

(75) Inventors: Kazuo Watada, Kyoto (JP); Shunichi Murakawa, Kyoto (JP); Akinori Sato, Kyoto (JP); Hiroshi Yoshizaki, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/134,139

(22) Filed: Apr. 26, 2002

(65) Prior Publication Data

US 2002/0190903 A1 Dec. 19, 2002

(30) Foreign Application Priority Data

Apr. 27, 2001 (JP) ..... P2001-133235

(51) Int. Cl.[7] ..... H01Q 1/38; H01Q 1/24
(52) U.S. Cl. ..... 343/895; 343/700 MS
(58) Field of Search ..... 343/895, 700 MS, 343/702, 873, 747, 806

(56) References Cited

U.S. PATENT DOCUMENTS 4,381,566 A * 4/1983 Kane ..... 455/193

FOREIGN PATENT DOCUMENTS

| | | |
|---|---|---|
| JP | 5-191117 | 7/1993 |
| JP | 6-62601 | 9/1994 |
| JP | 9-55618 | 2/1997 |
| JP | 11-68424 | 3/1999 |
| JP | 11-122011 | 4/1999 |
| JP | 2001-217631 | 8/2001 |

OTHER PUBLICATIONS

*JP 5–191117 corresponds with four U.S. patent application Nos. 5,400,000; 5,382,927; 5,381,117; and 5,351020.
** JP 9–55618 corresponds with European Patent Application No. EP 0762539.

* cited by examiner

*Primary Examiner*—James Clinger
(74) *Attorney, Agent, or Firm*—Hogan & Hartson

(57) ABSTRACT

It is an object of the invention to provide a meander antenna that is smaller and lighter, in which the resonance frequency easily can be tuned, as well as a method for tuning its resonance frequency. The meander antenna comprises a meandering conductor on the surface of a substrate. The meander antenna is provided with a short-circuit conductor line that forms a short-circuit between two parallel opposing lines into which the conductor is bent, or an open conductor line in which a line short-circuiting the two parallel opposing lines is open. The resonance frequency can be tuned and lowered by cutting open the short-circuit line or increased by short-circuiting the open conductor line.

20 Claims, 5 Drawing Sheets

MEANDER ANTENNA AND METHOD FOR TUNING RESONANCE FREQUENCY OF THE SAME

BACKGROUND OF THE INVENTION

1. Field of the Invention

The present invention relates to a compact meander antenna that can be used, for example, in a mobile communication terminal or a local area network (LAN), and to a method for tuning its resonance frequency.

2. Description of the Related Art

Antennas in conventional mobile communication terminals are generally of a type in which a whip antenna 21 is attached to a casing 22 of a communication terminal, as illustrated for example in the perspective view of FIG. 6.

In recent years, progress in mobile communications and the diversification of services has led to the spread of portable terminals and, in view of portability, to communication terminals with more compact casings. Accordingly, components that are integrated or attached are becoming smaller and lighter. However, since the conventional whip antenna 21 protrudes from the casing 22, a more compact design in which also the antenna does not protrude from the casing is desirable in order to make the terminal even more compact. Also a lighter weight is desirable.

In order to fulfill this need, meander antennas having, as a compact antenna, a radiation electrode made of a meandering conductor have been developed.

For example, FIG. 7 is a perspective view of a chip antenna disclosed in Japanese Unexamined Patent Publication JP-A 9-55618 (1997). In this chip antenna, a meandering conductor 13 is provided on an upper side of a substrate 11. The meandering conductor 13 is connected by a feed terminal 17 to a contact portion of a terminal electrode 12 provided on a lateral side of a substrate 11. Thus, the antenna can be made more compact by providing the conductor 13 serving as the radiation electrode with a meandering shape.

It is known that in this meander antenna, as in a $\lambda/4$ (quarter wavelength) monopole antenna, the resonance frequency depends on the ground size of the base to which the substrate is attached. Consequently, it is necessary to design the pattern, that is, shape and dimensions of the conductor, such that the desired resonance frequency is attained, in accordance with the ground size of the base.

However, there is a problem that in meander antennas that have been made compact by making the conductor meandering, the resonance frequency tends to vary due to increased capacitance and electric coupling between the conductor lines, and due to the dielectric constant of the substrate, for example.

SUMMARY OF THE INVENTION

In order to solve these problems, it is an object of the invention to provide a compact meander antenna whose resonance frequency can be tuned easily, and with which adaptation to ground bases of various sizes is possible, while it is possible to adjust variations of the resonance frequency occurring due to manufacturing variations to a level that is usable with respect to the target resonance frequency, as well as to provide a method for tuning the resonance frequency of such a meander antenna.

As a result of intense studies into conductor patterns for meander antennas, the inventors of the invention found that these objects can be achieved as described below, and thus conceived of the invention.

The invention provides a meander antenna comprising:

a meandering conductor that is formed on a surface of a substrate made of a dielectric material or a magnetic material; and a short-circuit conductor line that forms a short-circuit between two parallel opposing lines into which the conductor is bent, or an open conductor line for short-circuiting the two parallel opposing lines. a meander antenna which includes a meandering conductor that Also the invention provides a meander antenna comprising:

a meandering conductor that is formed inside a substrate made of a dielectric material or a magnetic material; and a short-circuit conductor line that forms a short-circuit between two parallel opposing lines into which the conductor is bent, or an open conductor line for short-circuiting the two parallel opposing lines, wherein the substrate is provided with a window portion at which the short-circuit conductor line and the open conductor line are exposed.

In the invention it is preferable that a plurality of short-circuit conductor lines or open conductor lines are provided between the two parallel opposing lines.

In the invention it is preferable that the short-circuit conductor lines or open conductor lines are arranged at a spacing that is within 2% of a total length of the meandering conductor.

The invention provides a method for tuning resonance frequency of the above-described meander antenna, comprising cutting open the short-circuit conductor line, or short-circuiting the open conductor line.

The invention provides a method for tuning resonance frequency of the above-described meander antenna, comprising successively cutting open the plurality of short-circuit conductor lines starting at the open side of the two lines, or successively short-circuiting the plurality of open conductor lines starting at the short-circuit side of the two lines.

In the invention it is preferable that, when f is the target resonance frequency, f' is the resonance frequency before tuning, a is a pattern length of the conductor short-circuited by the short-circuit conductor lines, and x is the tuning length of the pattern length necessary to obtain the target resonance frequency f after tuning, then the short-circuit conductor lines are cut open such that the tuning length best approximates the tuning length x derived from the equation $x=(f'/f-1)a$.

In the invention it is preferable that, when f is the target resonance frequency, f' is the resonance frequency before tuning, b is a pattern length of the conductor before short-circuiting open conductor lines, and y is the tuning length of the pattern length necessary to obtain the target resonance frequency f after tuning, then the open conductor lines are short-circuited such that the tuning length best approximates the tuning length y derived from the equation $y=(1-f'/f)b$.

In the invention it is preferable that the short-circuit conductor lines are arranged on the short-circuit side of the two parallel opposing lines, and the open conductor lines are arranged on the open side of the two parallel opposing lines.

The invention provides a method for tuning the resonance frequency of the above-described meander antenna, comprising cutting open the short-circuit conductor lines, or short-circuiting the open conductor lines.

In the invention, it is preferable that relative dielectric constant $\epsilon_r$ of the dielectric material is 3 to 120, or magnetic permeability $\mu$ of the magnetic material is 1 to 8.

According to the invention, a meander antenna is provided with a short-circuit conductor line that forms a short-circuit between two parallel opposing lines into which a meandering conductor formed on a substrate has been bent, or an open conductor line for short-circuiting the two parallel opposing lines is open. Consequently, when an antenna has been manufactured in which the resonance frequency is higher than the target resonance frequency, then the resonance frequency can be tuned and lowered by extending the pattern length of the meandering conductor by cutting open the short-circuit conductor line. Or, when an antenna has been manufactured in which the resonance frequency is lower than the target resonance frequency, then the resonance frequency can be tuned and increased by shortening the pattern length of the meandering conductor by short-circuiting the open conductor line. As a result, the resonance frequency of a compact meander antenna can be tuned easily, and adaptation to ground bases of various sizes is possible, while it is possible to adjust variations of the resonance frequency occurring due to manufacturing variations to a level that is usable with respect to the target resonance frequency.

Furthermore, if a plurality of short-circuit conductor lines or open conductor lines are formed between the two parallel opposing lines, then it is possible to tune and gradually increase or decrease the resonance frequency by successively cutting them open or short-circuiting them. If the short-circuit conductor lines and the open conductor lines are arranged at a spacing that is within 2% of the total length of the meandering conductor, then a tuned resonance frequency can be achieved that is kept within 4% of the target resonance frequency, and the resonance frequency can be tuned to a level that poses no problem in practice.

Furthermore, it is possible to approximate the target resonance frequency by gradually decreasing or increasing the resonance frequency by successively cutting open the short-circuit conductor lines starting at the open side of the two parallel opposed lines if a plurality of short-circuit conductor lines are cut open, or by successively short-circuiting the open conductor lines starting at the short-circuit side of the two parallel opposed lines if a plurality of open conductor lines are short-circuited. Furthermore, when f is the target resonance frequency, f' is the resonance frequency before tuning, a is a pattern length of the conductor short-circuited by the short-circuit conductor lines, and x is the tuning length of the pattern length necessary to obtain the target resonance frequency f after tuning, then it is possible to tune the resonance frequency efficiently such that the resonance frequency is kept for example within ±2% of the target resonance frequency f by cutting the short-circuit conductor lines open such that the tuning length best approximates the tuning length x derived from the equation $x=(f'/f-1)a$. Or, when f is the target resonance frequency, f' is the resonance frequency before tuning, b is a pattern length of the conductor before short-circuiting open conductor lines, and y is the tuning length of the pattern length necessary to obtain the target resonance frequency f, then it is possible to tune the resonance frequency efficiently such that the resonance frequency is kept for example within ±2% of the target resonance frequency f by short-circuiting the open conductor lines such that the tuning length best approximates the tuning length y derived from the equation $y=(1-f'/f)b$.

Furthermore, it is possible to tune and increase or decrease the resonance frequency by arranging the short-circuit conductor lines on the short-circuit side of the two parallel opposing lines and the open conductor lines on the open side of the two parallel opposing lines, and cutting open the short-circuit conductor lines or short-circuiting the open conductor lines, thus making it possible to efficiently tune to the target resonance frequency.

The invention provides a compact meander antenna whose resonance frequency can be tuned easily, and with which adaptation to ground bases of various sizes is possible, while it is possible to adjust variations of the resonance frequency occurring due to manufacturing variations to a level that is usable with respect to the target resonance frequency, as well as a method for tuning the resonance frequency of such a meander antenna.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
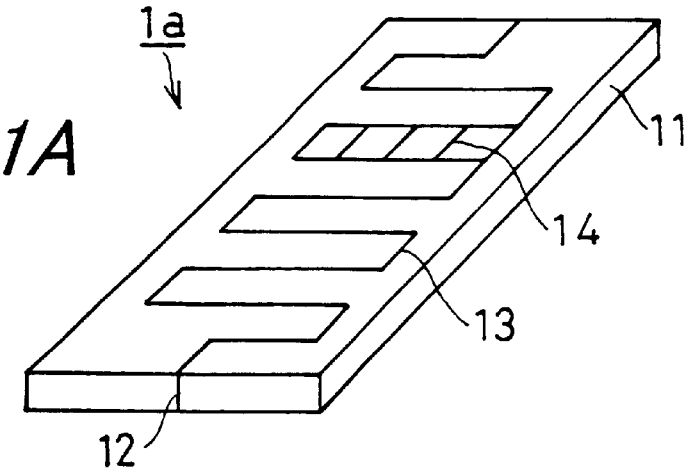
FIG. 1A is a perspective view of a meander antenna according to a first embodiment of the invention.

Now referring to the drawings, preferred embodiments of the invention are described below.

Figure 1B:
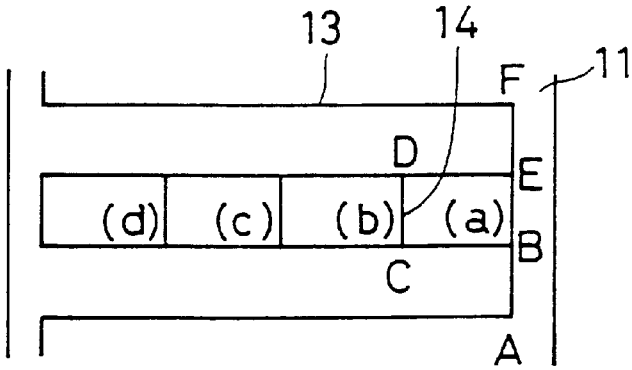
FIG. 1B is a top view showing the essential part of the meander antenna according to the first embodiment.
Figure 1C:
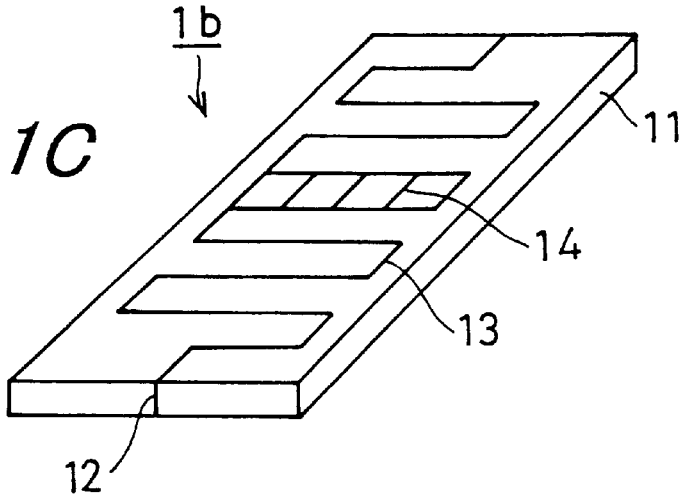
FIG. 1C is a perspective view of a meander antenna according to a second embodiment of the invention.
Figure 2A:
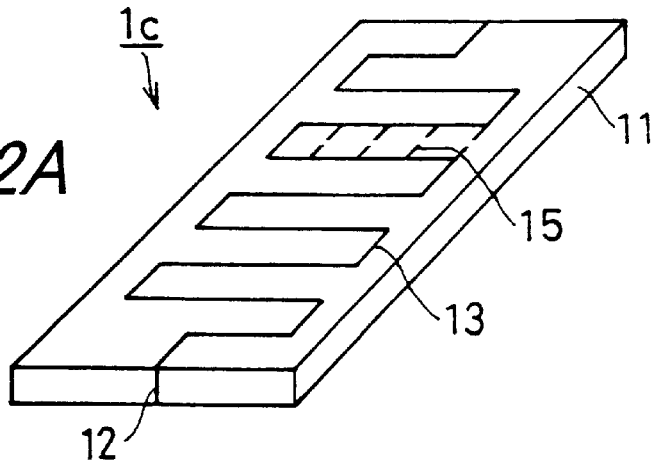
FIG. 2A is a perspective view of a meander antenna according to a third embodiment of the invention.
Figure 2B:
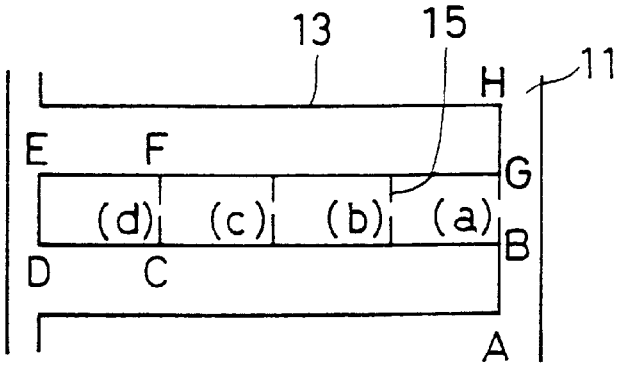
FIG. 2B is a top view showing the essential part of the meander antenna according to the third embodiment.
Figure 2C:
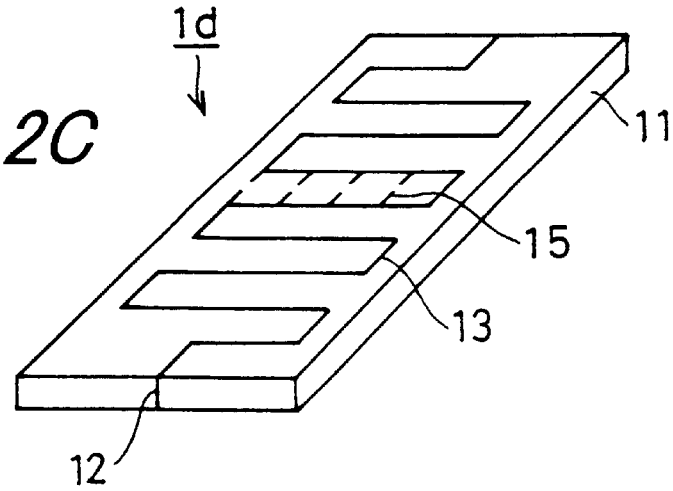
FIG. 2C is a perspective view of a meander antenna according to a fourth embodiment of the invention.
Figure 3A:
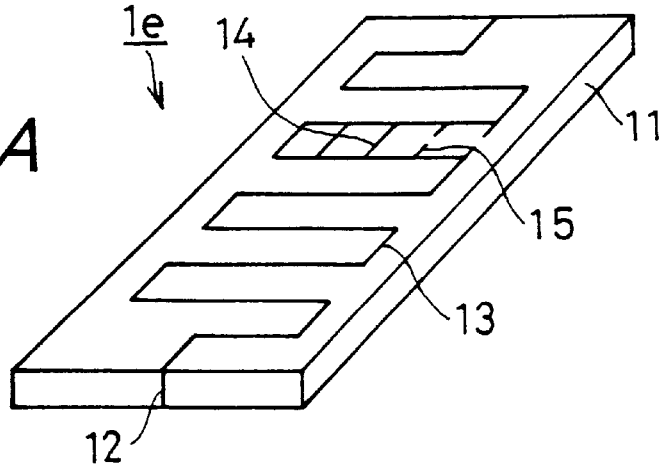
FIG. 3A is a perspective view of a meander antenna according to a fifth embodiment of the invention.
Figure 3B:
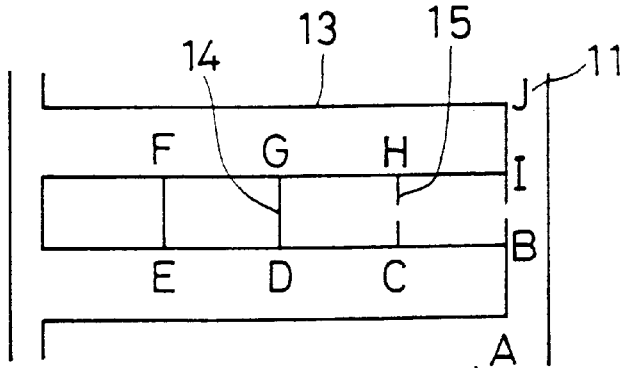
FIG. 3B is a top view showing the essential part of the meander antenna according to the fifth embodiment.
Figure 3C:
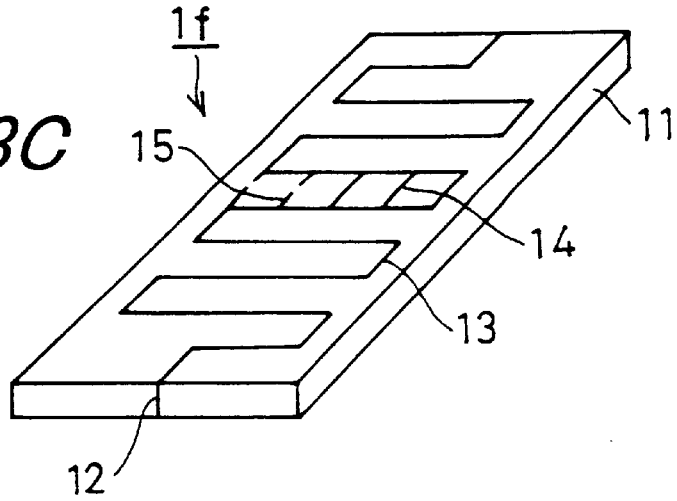
FIG. 3C is a perspective view of a meander antenna according to a sixth embodiment of the invention.

FIGS. 1A to 1C, 2A to 2C and 3A to 3C show first to sixth embodiments of meander antennas according to the invention. FIGS. 1A, 2A and 3A are perspective views of meander antennas according to the first, third and fifth embodiments. FIGS. 1B, 2B and 3B are top views showing examples of short-circuit conductor lines and open conductor lines illustrating a method for tuning the resonance frequency in the meander antennas of the first, third and fifth embodiments. FIGS. 1C, 2C and 3C are perspective views, like FIGS. 1A, 2A and 3A, showing meander antennas according to the second, fourth and sixth embodiments.

In FIGS. 1A–1C to 3A–3C, like portions have been marked by like numerals. Numerals 1*a* to 1*f* denote meander antennas according to the first to sixth embodiments of the invention. Numeral 11 denotes a substrate, numeral 12 denotes a feed terminal provided at a lateral side of the substrate 11, and numeral 13 denotes a meandering conductor formed on a surface of the substrate 11. Numeral 14 denotes short-circuit conductor lines provided between two parallel opposing lines into which the conductor 13 has been bent, and shorting those lines. Numeral 15 denotes open conductor lines similarly provided between two parallel opposing lines into which the conductor 13 has been bent, and which are cut open midway between shorting the two parallel opposing lines.

The meander antennas 1*a* to 1*f* shown in these drawings are used for mobile communication or for LANs. The antennas 1*a* to 1*f* include a linear conductor 13 meandering in longitudinal direction of the substrate 11 provided on the surface of a substantially rectangular solid-shaped substrate 11 made, for example, of a ceramic, and a feed terminal 12 for applying a high-frequency signal voltage to this conductor 13. The bent portions within the conductor 13 are provided with short-circuit conductor lines 14 and open conductor lines 15 as a resonance frequency tuning pattern.

It should be noted that all of these embodiments illustrate antennas in which the conductor 13 is formed on the surface of the substrate 11, in which case the structure is simple and requires no lamination or the like, so that the antennas can manufactured easily and at low cost.

Figure 5A:
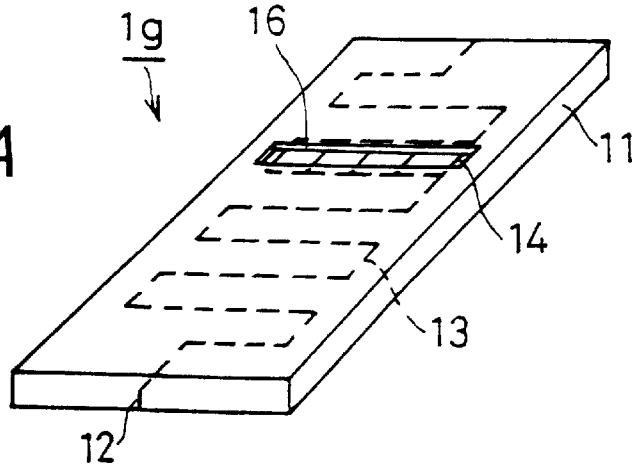
FIG. 5A is a perspective view of a meander antenna according to a seventh embodiment of the invention.
Figure 5B:
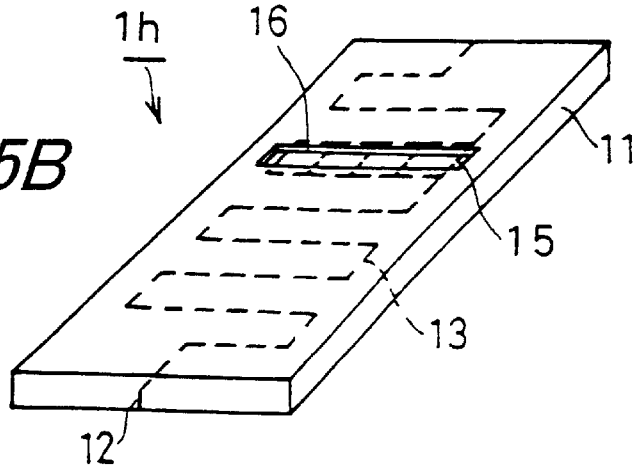
FIG. 5B is a perspective view of a meander antenna according to an eighth embodiment of the invention.
Figure 6:
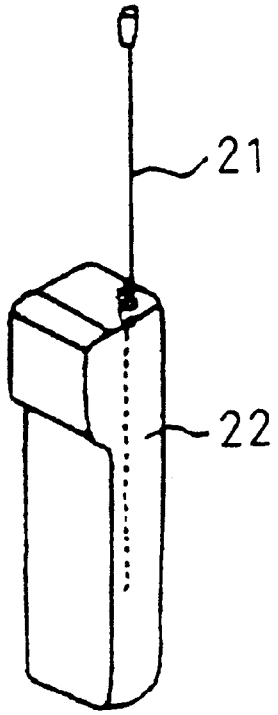
FIG. 6 PRIOR ART
FIG. 6 illustrates a communication terminal equipped with a whip antenna.
Figure 7:
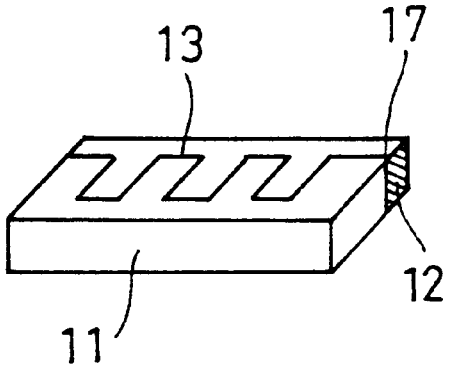
FIG. 7 PRIOR ART
FIG. 7 is a perspective view illustrating a conventional chip antenna.

It is, however, also possible to form the conductor 13 inside the substrate 11, as in the meander antennas 1*g* and 1*h* of the seventh and eighth embodiments shown in FIGS. 5A and 5B. In this case, there is the advantage that the dielectric constant of the dielectric can be set as desired in a vertical direction of the conductor 13, which makes the tuning of its characteristics easier. Furthermore, since the conductor 13 is not exposed at the surface, the influence of dielectrics near the antenna can be suppressed to a low level. Moreover, in this case, the substrate 11 is provided with a window portion 16 in which structural material of the substrate 11 has been removed, thus making the short-circuit conductor lines 14 and open conductor lines 15 provided in the conductor 13 accessible.

Furthermore, it is also possible to form the conductor 13 as well as the short-circuit conductor lines 14 and open conductor lines 15 both at the surface and inside the substrate 11, in which case the environment (such as the dielectric constant) around the conductor 13 is different at the surface and on the inside, making it possible to attain a plurality of different characteristics.

The substrate 11 is made of a dielectric material or a magnetic material, for example a ceramic that is made by pressure-forming a powder of a dielectric material (relative dielectric constant: 9.6) whose main component is alumina. It is also possible to use a compound material of a ceramic and a resin, serving as a dielectric material, or to use a magnetic material, such as a ferrite for the substrate 11.

By making the substrate 11 of a dielectric material, the propagation speed of high-frequency signals propagating along the conductor 13 is slowed, thus generating shorter wavelengths. When $\epsilon_r$ is the relative dielectric constant of the substrate 11, then the effective length of the pattern of the conductor 13 is reduced by a factor of $1/\epsilon_r^{1/2}$. Consequently, for the same pattern length, the area of the current distribution increases, so that the amount of electromagnetic waves radiated from the substrate 13 can be enlarged, and the gain of the antenna can be improved.

Conversely, with the same characteristics as in conventional antenna characteristics, the pattern length of the substrate 13 can be set to $1/\epsilon_r^{1/2}$, thus allowing a more compact design.

It should be noted that if the substrate 11 is made of a dielectric material and the relative dielectric constant $\epsilon_r$ is lower than 3, then it approaches the dielectric constant of air ($\epsilon_r$=1), and for the reasons stated above, it becomes difficult to respond to the demand of the market for more compact antennas. Furthermore, if $\epsilon_r$ is greater than 120, then, even though a more compact antenna is possible, the gain and the bandwidth of the antenna may become too small, because the gain and the bandwidth are proportional to the antenna size, and there is the risk that the characteristics required by the antenna cannot be achieved. Thus, it is preferable to use a dielectric material with a relative dielectric constant $\epsilon_r$ of 3 to 120. Examples of such dielectric materials are ceramic materials, such as alumina or zirconia, and resin materials, such as tetrafluoroethylene or glass epoxy.

On the other hand, when the substrate 11 is made of a magnetic material, the impedance of the substrate 13 becomes large, so that the Q of the antenna becomes low, and the bandwidth can be broadened.

If the substrate 11 is made of a magnetic material and the magnetic permeability $\mu$ is larger than 8, then, even though the antenna bandwidth is broadened, the antenna gain may become too small, because the gain and the bandwidth are proportional to the antenna size, and there is the risk that the characteristics required by the antenna cannot be achieved. Thus, it is preferable to use a magnetic material with a magnetic permeability $\mu$ of 1 to 8. Examples of such magnetic materials are YIG (yttrium iron garnet), Ni—Zr compounds and Ni—Co—Fe compounds.

The meandering conductor 13, the feed terminal 12, the short-circuit conductor lines 14, and the open conductor lines 15, which constitute the electrode pattern of the antenna, are made of a metal whose main component is aluminum, copper, nickel, silver, palladium, platinum or gold, for example. To form the patterns with these metals, the desired pattern shape may be formed, as known in the art, by a thin-film forming method such as printing, vapor deposition or sputtering, by laminating a metal foil, or by plating.

In the meander antenna la shown in the perspective view of FIG. 1A in the first embodiment of the invention, a plurality of short-circuit conductor lines 14 are provided between two parallel opposing lines into which the conductor 13 has been bent, shorting the two parallel opposing lines, as shown in the top view of FIG. 1B. Such short-circuit conductor lines 14 are similarly provided in the meander antenna 1*b* shown in the perspective view of FIG. 1C in the second embodiment of the invention. The short-circuit conductor lines 14 function as a conductor pattern for tuning the resonance frequency of the meander antennas 1*a* and 1*b*. If a meander antenna 1*a* or 1*b* has been manufactured, whose resonance frequency is higher than the designed target value, then by trimming and cutting open the short-circuit conductor lines 14, the pattern length of the conductor 13 whose electrical pattern length the short-circuit conductor lines 14 have made shorter than the original meandering pattern can be prolonged in correspondence with the distance to the next short-circuit conductor line 14, or, if there is no next short-circuit conductor line 14, in correspondence with the distance to the bent portion. Thus, it is possible to tune the resonance frequency and make it lower.

It should be noted that if a plurality of short-circuit conductor lines 14 are formed, then it is possible to successively tune the resonance frequency and make it lower by successively trimming and cutting open the short-circuit conductor lines 14 starting with the short-circuit conductor line 14 that is positioned near the open side (side near the entrance to the U-shaped portion) of the pattern of parallel opposing portions into which the meandering conductor 13 has been bent. For example, if in the example shown in FIG. 1B only the short-circuit conductor line 14(*a*) is cut open, then the electrical path of the antenna prior to the cutting open is A-B-E-F, and after the cutting open changes to A-B-C-D-E-F, making the pattern length of the conductor 13 longer. Thus, it is possible to tune the resonance frequency and make it lower. By successively cutting open the short-circuit conductor lines 14(*b*), (*c*) and (*d*) in this manner, the resonance frequency can be successively tuned and gradually made lower.

This is in accordance with the equation $f=c/\lambda$ (wherein f is the resonance frequency, c is the speed of light, and $\lambda$ is the wavelength). Increasing the wavelength $\lambda$ (which corresponds to the pattern length of the conductor 13 in the meander antennas 1*a* and 1*b* of the invention) reduces the resonance frequency f.

In the meander antenna 1*c* shown in the perspective view of FIG. 2A in the third embodiment of the invention, a plurality of open conductor lines 15 are provided between two parallel opposing lines into which the conductor 13 has been bent, for shorting those strips, as shown in the top view of FIG. 2B. Such open conductor lines 15 are similarly provided in the meander antenna 1*d* shown in the perspective view of FIG. 2C in the fourth embodiment of the invention. The open conductor lines 15 too function as a conductor pattern for tuning the resonance frequency of the meander antenna 1. If a meander antenna 1*c* or 1*d* has been manufactured whose resonance frequency is lower than the designed target value, then the open conductor lines 15 are short-circuited for example by dipping or laminating a conductive tape or the like. Thus, the electrical pattern length of the conductor 13 can be made shorter than the pattern length of the original meandering pattern in correspondence with the distance to the short-circuited open conductor line 15. Thus, it is possible to tune the resonance frequency and make it higher.

It should be noted that if a plurality of open conductor lines 15 are formed, then it is possible to successively tune the resonance frequency and gradually make it higher by successively short-circuiting the open conductor lines 15 from the open conductor line 15 that is positioned near the short-circuit side (side away from the entrance to the U-shaped portion) of the pattern of parallel opposing portions into which the meandering conductor 13 has been bent. For example, in the example shown in FIG. 2B, in which only the open conductor line 15(*d*) has been short-circuited, the electrical path of the antenna prior to the short-circuiting is A-B-C-D-E-F-G-H, and after the short-circuiting changes to A-B-C-F-G-H, making the pattern length of the conductor 13 shorter. Thus, it is possible to tune the resonance frequency and make it higher. By successively cutting open the short-circuit conductor lines 15(*c*), (*b*) and (*a*) in this manner, the resonance frequency can be successively tuned and gradually made higher.

This is in accordance with the equation $f=c/\lambda$ (wherein f is the resonance frequency, c is the speed of light, and $\lambda$ is the wavelength). Increasing the wavelength $\lambda$ (which corresponds to the pattern length of the conductor 13 in the meander antennas 1*c* and 1*d* of the invention) reduces the resonance frequency f.

It should be noted that in the above embodiments of the invention, the short-circuit conductor lines 14 and the open conductor lines 15 of the pattern conductor for tuning the resonance frequency are formed in only one bent portion (U-shaped portion) of the meandering conductor 13, but it is also possible to form them at a plurality of bent portions (U-shaped portions), in which case the tuning range of the resonance frequency is broadened.

It is, however, preferable that the short-circuit conductor lines 14 and the open conductor lines 15 are not formed in two continuous bent portions (U-shaped portions). The reason for this is that, depending on the design of the short-circuit conductor lines 14 and the open conductor lines 15, it may occur that the cutting open of the short-circuit conductor lines 14 and the short-circuiting of the open conductor lines 15, will not change the electrical pattern length of the conductor 13, so that they do not function as a pattern for tuning the resonance frequency.

In meander antennas as the meander antennas 1*a* to 1*h* of the invention, the bandwidth is generally broad, and they have a bandwidth of about 10% of the resonance frequency. For this reason, even if the resonance frequency is slightly off, it is still possible to cover the used frequency band. More specifically, assuming that the bandwidth of meander antennas for Bluetooth is 10% (at a center frequency of 2450 MHz), then one half-band becomes 5% (about 120 MHz). That is to say, even when the resonance frequency is shifted 70 MHz from the target value, then it is still theoretically possible to cover the used frequency band (2400 MHz to 2500 MHz).

However, in the case of $\lambda/4$ monopole antennas, there is the possibility that the resonance frequency shifts depending on the usage environment. Therefore, when taking 20 MHz as a safety factor, it can be seen that resonance frequency shifts of up to 50 MHz from the target value are tolerable. This corresponds to 2% of the Bluetooth center frequency of 2450 MHz. For other applications such as GPS (global positioning system) and PHS (personal handyphone systems), the used frequency band is much smaller than 100 MHz. That is to say, when the resonance frequency shifts are kept to within 2% of the target resonance frequency, then usage is possible with antennas for any application. Consequently, if the resonance frequency is tuned in the meander antennas 1*a* to 1*h* of the invention, it is preferable that the resonance frequency is tuned to ±2% of the target resonance frequency by cutting open the short-circuit conductor lines 14 or short-circuiting the open conductor lines 15 of the resonance frequency tuning pattern.

Thus, it is preferable that in the meander antennas 1*a* to 1*h* of the invention, the short-circuit conductor lines 14 and the open conductor lines 15 of the resonance frequency tuning pattern are arranged at a spacing within 2% of the total length of the meandering conductor 13. The reason for this is that if the spacing between them is more than 2% of the total length of the conductor 13, then the tuning range of the resonance frequency with the short-circuit conductor lines 14 and the open conductor lines 15 becomes larger than 4%, so that the displacement of the tuned resonance frequency from the target resonance frequency cannot be reduced to less than 2%.

In conductor patterns serving as antenna radiation electrodes, the resonance frequency and the signal wavelength are inversely proportional to one another, and to tune the resonance frequency by 4% for example, it is necessary to adjust the wavelength of the signal by about 4%. Consequently, in the meander antennas 1*a* to 1*h* of the invention, to tune the resonance frequency by 4% for example, the pattern length of the conductor 13 has to be tuned by about 4%, so that it is preferable to arrange the short-circuit conductor lines 14 and the open conductor lines 15 at spacings of 2% of the total conductor 13.

However, in practice, meander antennas are influenced by the capacitances between the lines of the conductor pattern, and even if the pattern length of the conductor is tuned by 4%, the amount that the resonance frequency has been tuned may be less than 4%. Consequently, the spacing at which the short-circuit conductor lines 14 and the open conductor lines 15 of the resonance frequency tuning pattern are arranged should be within 2% of the total length of the conductor 13, and the pattern length of the conductor 13 tuned by the cutting process and the short-circuiting process should be designed to be within 4% of the total length of the conductor 13 of the meander antenna.

It should be noted that here, "total length of the conductor 13" refers to the total length of the meandering pattern without the short-circuit conductor lines 14 and the open conductor lines 15.

In the meander antennas 1*a* to 1*h* of the invention, the resonance frequency is inversely proportional to the signal wavelength, as explained above. This means that when f' is the resonance frequency before the tuning, f is the target resonance frequency, a is the pattern length of the conductor 13 before the cutting of the short-circuit conductor lines 14, b is the pattern length of the conductor 13 before the short-circuiting of the open conductor lines 15, and x and y are the tuning length of the pattern necessary to obtain the desired resonance frequency, the following equations (1) and (2) hold:

$$f'>f:\ f'a=f(a+x) \quad (1)$$

$$f'>f:\ f'b=f(b-y) \quad (2)$$

This can be derived from the equation $f=c/\lambda$ mentioned earlier.

Equation (1) describes the case that the resonance frequency before the tuning is higher than the target resonance frequency. In this case, when x is the pattern tuning length that is necessary to obtain the target resonance frequency f, then the short-circuit conductor lines 14 are cut open such that the tuning length becomes closest to the tuning length x that is derived from $x=(f'/f-1)a$. Thus, the resonance frequency f' prior to the tuning is lowered, and the target resonance frequency f can be approximated. On the other hand, equation (2) describes the case that the resonance frequency before the tuning is lower than the target resonance frequency. In this case, when y is the pattern tuning length that is necessary to obtain the target resonance frequency f, then the open conductor lines 15 are short-circuited such that the tuning length becomes closest to the tuning length y that is derived from $y=(1-f'/f)b$. Thus, the resonance frequency f' prior to the tuning is increased, and the target resonance frequency f can be approximated.

It should be noted that by tuning the pattern length of the conductor 13 as described above by the tuning length x or y, it is theoretically possible to attain the target resonance frequency f, but in practice, a tuning of the meander antennas to the target resonance frequency f may not be achieved, even when tuning the pattern length by the tuning length x or y determined by the above-noted equations, due to the influence of capacitances between the lines of the conductor pattern. In that case, based on a first tuning result, the resonance frequency tuning amount per short-circuit conductor line 14 or open conductor line 15 may be determined again, and a second tuning of the resonance frequency may performed based on the calculation result. Fine tuning the resonance frequency by cutting open or short-circuiting the short-circuit conductor lines 14 and open conductor lines 15 one by one, and processing a number of short-circuit conductor lines 14 or open conductor lines 15 that best approximates the tuning lengths x or y determined by the Equations (1) and (2), and subsequently tuning the resonance frequency again, it is possible to tune the resonance frequency to within ±2% of the target resonance frequency f by cutting open or short-circuiting not more than twice.

In the meander antennas 1*g* and 1*h* of the invention, it is also possible to form the conductor 13 inside the substrate 11, as noted above. In this case, to tune the resonance frequency by cutting open the short-circuit conductor line 14 or short-circuiting the open conductor line 15, the substrate 11 may be provided with a window portion 16 exposing the short-circuit conductor lines 14 and the open conductor lines 15, which makes it possible to perform the processing and tuning easily and without hindrance due to the substrate 11 covering the surface of the conductor 13.

Figure 4:
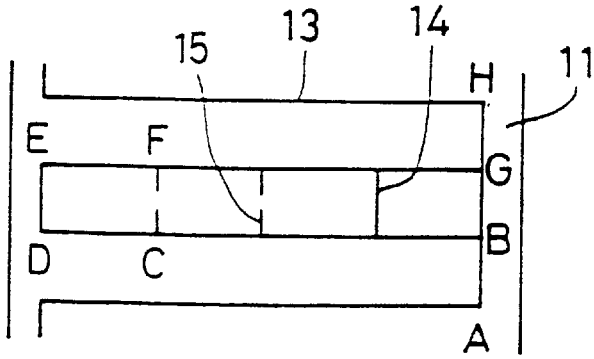
FIG. 4 is a plan view showing an example of the arrangement of the short-circuit conductor lines and the open conductor lines.

In the meander antenna 1*e* of the invention, it is also possible to form both short-circuit conductor lines 14 and open conductor lines 15 between two parallel opposing lines into which the meandering conductor 13 has been bent, as shown in FIGS. 3A and 3B. Thus, it is possible to tune the resonance frequency and make it higher or lower, as appropriate. Furthermore, it is preferable that the short-circuit conductor lines 14 are arranged on the short-circuit side (to the inner side of the U-shape) of a bent portion of the conductor 13, and the open conductor lines 15 are arranged on the open side (near the entrance of the U-shape) of the bent portion of the conductor 13. This is because if the arrangement were the other way around, then, as can be seen from the top view in FIG. 4, if the open conductor lines 15 are arranged on the short-circuit side (to the inner side of the U-shape) of a bent portion of the conductor 13, then even if they are short-circuited, the path of the conductor pattern stays A-B-G-H due to the short-circuit conductor line 14 arranged on the open side (at the entrance of the U-shape) of the bent portion, so that it is not possible to tune and raise the resonance frequency by shortening the pattern length of the conductor 13.

WORKING EXAMPLES

The following is an explanation of specific examples of a meander antenna in accordance with the invention.

Working Example 1

A sample meander antenna having four short-circuit conductor lines as resonance frequency tuning pattern portions arranged between two parallel opposing lines into which the conductor is bent as shown in FIG. 1A was produced by printing and baking an Ag paste on a ceramic substrate. Then, it was examined how the resonance frequency changes when one to four of the short-circuit conductor lines of the antenna were successively cut open, starting at the open side of the bent portion. The cutting was carried out by trimming with a carbon gas laser. Moreover, the meander antenna was soldered onto a base produced by forming a ground surface on one principal surface of a glass epoxy base of 60 mm×25 mm×0.8 mm dimensions and forming a strip line on the other principal surface. A high-frequency signal was fed with a coaxial line from the opposite end, and the resonance frequency was measured with a network analyzer by Agilent Technologies. The results are shown in Table 1. It should be noted that Table 1 also shows the ratio of the tuning length (pattern tuning ratio) to the total length of the conductor, when tuning by cutting open the short-circuit conductor lines.

TABLE 1

| position of short-circuit conductor line | Resonance frequency (GHz) FIG. 1A | FIG. 1C | pattern tuning ratio |
|---|---|---|---|
| no short-circuit conductor line cut open | 2.270 | 2.260 | 0% |
| 1 short-circuit conductor line cut open | 2.240 | 2.235 | 3.96% |
| 2 short-circuit conductor lines cut open | 2.200 | 2.195 | 7.91% |
| 3 short-circuit conductor lines cut open | 2.170 | 2.155 | 11.87% |
| 4 short-circuit conductor lines cut open | 2.130 | 2.120 | 15.82% |

As can be seen from the results in Table 1, it was found that by increasing the number of short-circuit conductor lines that are cut, the resonance frequency can be successively tuned and lowered in accordance with the pattern tuning ratio. Furthermore, as also shown in Table 1, similar results were attained when arranging the short-circuit conductor lines at different positions, as shown in FIG. 1C, which is a perspective view analogous to FIG. 1A.

Working Example 2

A sample meander antenna having four open conductor lines as resonance frequency tuning pattern portions arranged between two parallel opposing lines into which the conductor is bent as shown in FIG. 2A was produced by printing and baking an Ag paste on a ceramic substrate. Then, it was examined how the resonance frequency changes when one to four open conductor lines of the antenna were successively short-circuited starting at the short-circuit side of the bent portion. The short-circuiting was carried out by applying a conductive paste to needle-shaped protrusions and transferring it to the open portion of the open conductor line, followed by baking. The results are shown in Table 2. It should be noted that Table 2 also shows the ratio of the tuning length (pattern tuning ratio) to the total length of the conductor, when short-circuiting the open conductor lines.

TABLE 2

| position of short-circuit conductor line | resonance frequency (GHz) FIG. 2A | FIG. 2C | pattern tuning ratio |
|---|---|---|---|
| no open conductor line short-circuited | 2.125 | 2.125 | 0% |
| 1 open conductor line short-circuited | 2.160 | 2.160 | 3.96% |
| 2 open conductor lines short-circuited | 2.200 | 2.200 | 7.91% |
| 3 open conductor lines short-circuited | 2.235 | 2.230 | 11.87% |
| 4 open conductor lines short-circuited | 2.270 | 2.260 | 15.82% |

As can be seen from the results in Table 2, it was found that by increasing the number of open conductor lines that are short-circuited, the resonance frequency can be successively tuned and made higher in accordance with the pattern tuning ratio. Furthermore, as also shown in Table 2, similar results were attained when arranging the open conductor lines at different positions, as shown in FIG. 2C, which is a perspective view analogous to FIG. 2A.

Furthermore, from the results of the Working Example 1 and the Working Example 2, it can be seen that the change of the resonance frequency for a pattern tuning ratio of about 4% is about 35 MHz, that is, is smaller than 88 MHz, which is a 4% frequency width for the case that the target resonance frequency is 2200 MHz. From this result, it was found that the spacing between the short-circuit conductor lines and the open conductor lines should be such that the pattern length (tuning length) of the meander antenna pattern tuned by cutting them open or short-circuiting them is within 4% of the total length of the conductor, or in other words, the spacing between the short-circuit conductor lines and the open conductor lines should be within 2% of the total length of the conductor.

According to the results of Working Example 1, to tune a resonance frequency of, for example, 2270 MHz to 2130 MHz, x is determined to be 2.78 mm by Equation 1. Thus, since the total length of the conductor is 42.22 mm and the tuning length per short-circuit conductor line is 1.67 mm, it is necessary to first cut open two short-circuit conductor lines. As a result, the resonance frequency becomes 2200 MHz, so that it is necessary to tune for another 70 MHz to reach the target resonance frequency. Here, the result is obtained that a tuning of 35 MHz per short-circuit conductor line was possible at the first cutting, so that when another two short-circuit conductor lines are cut open, the target resonance frequency of 2130 MHz is attained.

Moreover, according to the results of Working Example 2, to tune a resonance frequency of, for example, 2125 MHz to 2270 MHz, y is determined to be 2.27 mm by Equation 2. Thus, since the total length of the conductor is 42.22 mm and the tuning length per short-circuit conductor line is 1.67 mm, it is necessary to first short-circuit one open conductor line. As a result, the resonance frequency becomes 2160 MHz, so that it is necessary to tune for another 110 MHz to reach the target resonance frequency. Here, the result is, obtained that a tuning of 35 MHz per open conductor line was possible at the first short-circuiting, so that when another three short-circuit conductor lines are cut open, the target resonance frequency of 2270 MHz is attained.

Working Example 3

A sample meander antenna having two short-circuit conductor lines and two open conductor lines (i.e. a total of four) as resonance frequency tuning pattern portions arranged between two parallel opposing lines into which the conductor is bent as shown in FIG. 3A was produced by printing and baking an Ag paste on a ceramic substrate. Then, it was examined how the resonance frequency changes when one or two short-circuit conductor lines of the antenna were successively cut open starting at the open side of the bent portion, or when one or two open conductor lines of the antenna were successively short-circuited starting at the short-circuit side of the bent portion. The results are shown in Table 3.

TABLE 3

| | resonance frequency (GHz) |
|---|---|
| 2 short-circuit conductor line cut open | 2.135 |
| 1 short-circuit conductor lines cut open | 2.170 |

TABLE 3-continued

| | resonance frequency (GHz) |
|---|---|
| before the tuning | 2.205 |
| 1 open conductor line short-circuited | 2.240 |
| 2 open conductor lines short-circuited | 2.275 |

As can be seen from the results in Table 3, it was found that when a plurality of short-circuit conductor lines and open conductor lines are formed between two parallel opposing lines into which the meandering conductor has been bent, then the resonance frequency can be tuned and lowered by cutting open the short-circuit conductor lines or increased by short-circuiting the open conductor lines. Furthermore, as shown in FIG. 3C, which is a perspective view analogous to FIG. 3A, similar results were attained when arranging the open conductor lines at different positions.

As becomes clear from the Working Examples 1 to 3 as described above, using the method for tuning the resonance frequency of a meander antenna in accordance with the invention, it is possible to tune and either increase or decrease the resonance frequency of the meander antenna.

It should be noted that the invention is in no way limited to the embodiments described above, and various variations within a scope that does not depart from the spirit of the invention are possible. For example, in the meander antenna of the Working Examples 1 to 3, a ceramic was used for the substrate, but it is also possible to use a dielectric material, such as a resin or a compound material of a ceramic and a resin for the substrate. Furthermore, it is also possible to use a magnetic material including nickel, cobalt or iron. Regardless whether a dielectric material or a magnetic material is used, it is in both cases possible to tune the resonance frequency toward the desired target value for the resonance frequency. Furthermore, if a ceramic is used for the substrate, then the ceramic raw material can be press-formed and baked, or a plurality of green sheets can be layered and baked.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A meander antenna, comprising:

a meandering conductor that is formed on a surface of a substrate made of a dielectric material or a magnetic material; and a short-circuit conductor line that forms a short-circuit between two substantially parallel opposing lines into which the meandering conductor is bent, or an open conductor line that forms an open circuit between the two substantially parallel opposing lines into which the meandering conductor is bent.

2. A meander antenna, comprising:

a meandering conductor that is formed inside a substrate made of a dielectric material or a magnetic material; and a short-circuit conductor line that forms a short-circuit between two substantially parallel opposing lines into which the meandering conductor is bent, or an open conductor line that forms an open circuit between the two substantially parallel opposing lines into which the meandering conductor is bent, wherein the substrate is provided with a window portion at which the short-circuit conductor line and the open conductor line are exposed.

3. The meander antenna of claim 1, wherein a plurality of short-circuit conductor lines or open conductor lines are provided between the two substantially parallel opposing lines.

4. The meander antenna of claim 2, wherein a plurality of short-circuit conductor lines or open conductor lines are provided between the two substantially parallel opposing lines.

5. The meander antenna of claim 3, wherein the short-circuit conductor lines or open conductor lines are arranged at a spacing that is equal to or less than 2% of a total length of the meandering conductor.

6. The meander antenna of claim 4, wherein the short-circuit conductor lines or open conductor lines are arranged at a spacing that is equal to or less than 2% of a total length of the meandering conductor.

7. A method for tuning resonance frequency of the meander antenna of claim 1, comprising:

cutting open the short-circuit conductor line, or short-circuiting the open conductor line.

8. A method for tuning resonance frequency of the meander antenna of claim 2, comprising:

cutting open the short-circuit conductor line, or short-circuiting the open conductor line.

9. A method for tuning resonance frequency of the meander antenna of claim 3, comprising:

successively cutting open the plurality of short-circuit conductor lines starting at the open side of the two substantially parallel opposing lines, or successively short-circuiting the plurality of open conductor lines starting at the short-circuit side of the two lines.

10. A method for tuning resonance frequency of the meander antenna of claim 4, comprising:

successively cutting open the plurality of short-circuit conductor lines starting at the open side of the two substantially parallel opposing lines, or successively short-circuiting the plurality of open conductor lines starting at the short-circuit side of the two lines.

11. The method for tuning resonance frequency of the meander antenna of claim 9, wherein when f is the target resonance frequency, f' is the resonance frequency before tuning, a is a pattern length of the conductor short-circuited by the short-circuit conductor lines, and x is the tuning length of the pattern length necessary to obtain the target resonance frequency f after tuning, then the short-circuit conductor lines are cut open such that the tuning length best approximates the tuning length x derived from the equation $x=(f'/f-1)a$.

12. The method for tuning resonance frequency of the meander antenna of claim 10, wherein when f is the target resonance frequency, f' is the resonance frequency before tuning, a is a pattern length of the conductor short-circuited by the short-circuit conductor lines, and x is the tuning length of the pattern length necessary to obtain the target resonance frequency f after tuning, then the short-circuit conductor lines are cut open such that the tuning length best approximates the tuning length x derived from the equation $x=(f'/f-1)a$.

13. The method for tuning resonance frequency of the meander antenna of claim 9, wherein when f is the target resonance frequency, f' is the resonance frequency before tuning, b is a pattern length of the conductor before short-circuiting open conductor lines, and y is the tuning length of the pattern length necessary to obtain the target resonance frequency f after tuning, then the open conductor lines are short-circuited such that the tuning length best approximates the tuning length y derived from the equation $y=(1-f'/f)b$.

14. The method for tuning resonance frequency of the meander antenna of claim 10, wherein when f is the target resonance frequency, f' is the resonance frequency before tuning, b is a pattern length of the conductor before short-circuiting open conductor lines, and y is the tuning length of the pattern length necessary to obtain the target resonance frequency f after tuning, then the open conductor lines are short-circuited such that the tuning length best approximates the tuning length y derived from the equation $y=(1-f'/f)b$.

15. The meander antenna of claim 1, wherein the short-circuit conductor lines are arranged on the short-circuit side of the two substantially parallel opposing lines, and the open conductor lines are arranged on the open side of the two parallel opposing lines.

16. The meander antenna of claim 2, wherein the short-circuit conductor lines are arranged on the short-circuit side of the two substantially parallel opposing lines, and the open conductor lines are arranged on the open side of the two substantially parallel opposing lines.

17. A method for tuning the resonance frequency of the meander antenna of claim 15, comprising cutting open the short-circuit conductor lines, or short-circuiting the open conductor lines.

18. A method for tuning the resonance frequency of the meander antenna of claim 16, comprising:

cutting open the short-circuit conductor lines, or short-circuiting the open conductor lines.

19. The meander antenna of claim 1, wherein relative dielectric constant $\epsilon_r$ of the dielectric material is 3 to 120, or magnetic permeability $\mu$ of the magnetic material is 1 to 8.

20. The meander antenna of claim 2, wherein relative dielectric constant $\epsilon_r$ of the dielectric material is 3 to 120, or magnetic permeability $\mu$ of the magnetic material is 1 to 8.

* * * * *